United States Patent [19]

Rowell et al.

[11] 4,265,333

[45] May 5, 1981

[54] PORTABLE FENCE STILE

[76] Inventors: Robert Rowell, Whispering Pines Trailer Park, Box 1008, Derry, N.H. 03038; Albert A. Hickey, 216 Dauphine Dr., West Monroe, La. 71291

[21] Appl. No.: 100,885

[22] Filed: Dec. 6, 1979

Related U.S. Application Data

[63] Continuation-in-part of Ser. No. 925,935, Oct. 25, 1978, abandoned.

[51] Int. Cl.[3] ..... E06C 7/48; E06C 1/04

[52] U.S. Cl. ..... 182/92; 182/93; 182/106; 182/206

[58] Field of Search ..... 182/106, 194, 189, 118, 182/119, 93, 104, 206, 92

[56] References Cited

U.S. PATENT DOCUMENTS

| | | | |
|---|---|---|---|
| 356,896 | 2/1887 | Sheldon | 182/118 |
| 2,364,521 | 12/1944 | Fairfax | 182/206 |
| 3,817,351 | 6/1974 | Mikkelson | 182/190 |
| 3,908,795 | 9/1975 | Gannon | 182/118 |

*Primary Examiner*—Reinaldo P. Machado

*Attorney, Agent, or Firm*—Strimbeck, Davis & Soloway

[57] ABSTRACT

A portable fence stile comprises in combination:

(a) a U-shaped metal tubing of a sufficient strength to support a man and adapted to have the legs thereof placed over a fence in a generally vertical position, (b) a foot support on each of the legs a stepping distance above the ends of the legs; and (c) a stabilizer plate between the legs at the upper portion thereof slideably connecting therewith and having an opening in said plate adapted to fit over the end of a fence post.

9 Claims, 2 Drawing Figures

PORTABLE FENCE STILE

RELATED APPLICATION

This application is a continuation-in-part of a patent application by the same inventors having the same title and filed Oct. 25, 1978, as Ser. No. 925,935, abandoned on the filing of the present application.

INTRODUCTION

This invention is a device to permit people to climb over livestock and property line fences without causing damage to the fence or personal injury to themselves. It is particularly useful to maintenance workers who have to walk pipelines which are intersected by fences.

The device of the present invention is quite portable. It is preferably constructed of lightweight aluminum tubing such that it is easy to carry from one fence crossing to the next.

The usual method of crossing a fence is to climb over, through or under it by hand or by providing a stationary fence stile at the crossing point. Climbing over, under or through a fence without any mechanical aid often results in torn clothing, personal injury and damage to the fence. The provision for stationary, permanent fence stiles is often far too costly.

In brief compass, the present invention is a portable fence stile comprising a U-shaped metal rod of a strength sufficient to support a man and adapted to have the legs of the U placed over a fence in a general vertical position. Each leg has a support at a suitable stepping distance above the end of the leg. In use the stile is placed over the fence such that the legs are vertical and one places a foot on one of the foot supports, swings the other foot up over the other fence and places it on the other support and then steps down on the other side.

In a preferred embodiment, the U-shaped member is made of a hollow metal tubing such as aluminum tubing whereby it is lightweight and easily carried.

Also preferably there is a stabilizer plate slideably placed between the two legs at their upper portions just beneath the end of the U or cross member. This stabilizer portion has openings in it to fit the end of the fence post. When the stile is placed over the fence, the stabilizer member is dropped over the post which helps to hold the stile in the vertical position as the user swings up and over the fence. It is convenient to have a rod or handle extending vertically upward from the stabilizing plate through the end of the U-shaped member. This rod is useful to help position the stabilizer plate over the fence post and to provide a handhold for the user.

DRAWINGS

DESCRIPTION

Figure 1:
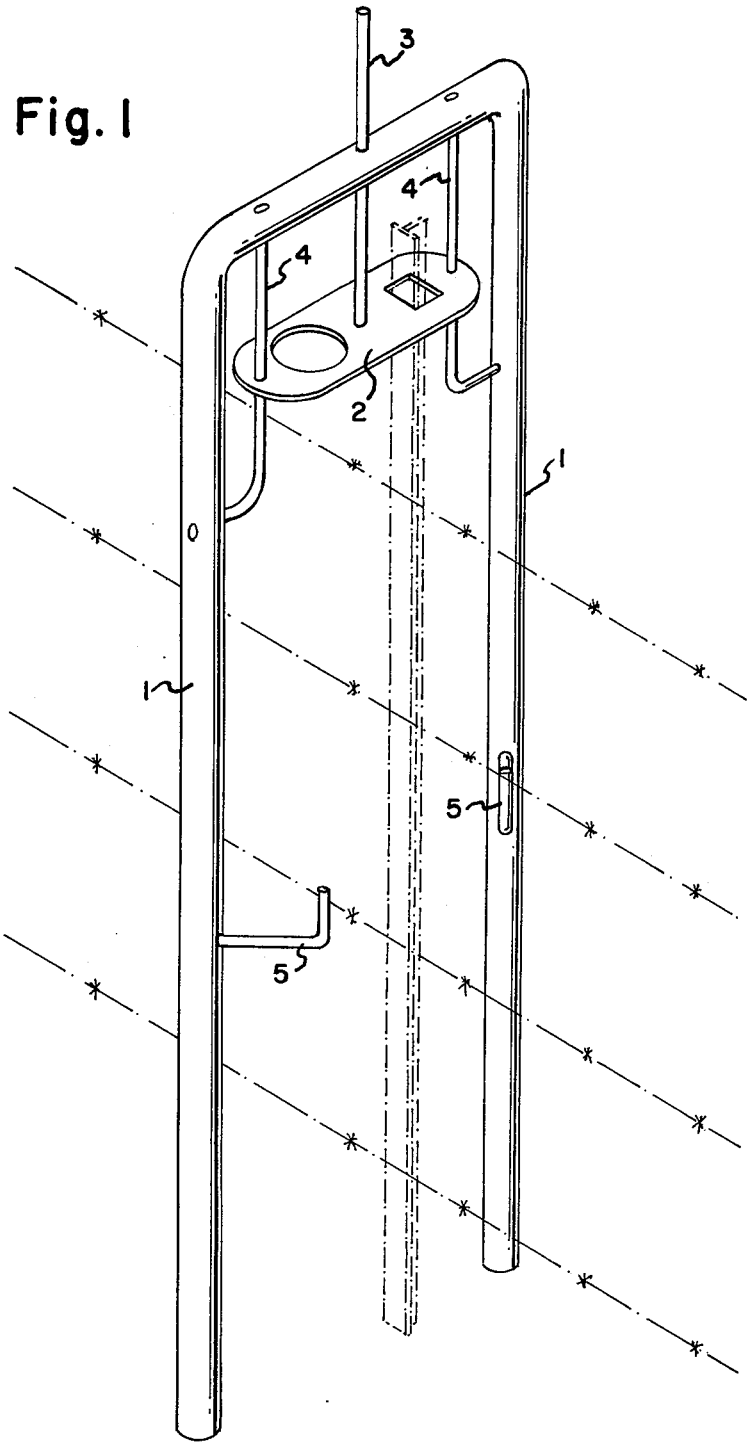
FIG. 1 is a perspective view of the stile of this invention showing it in place over a fence post illustrated in shadow outline.
Figure 2:
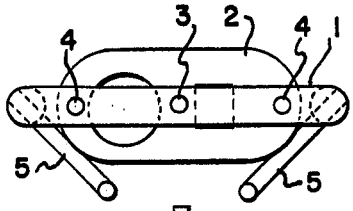
FIG. 2 is a top view of the stile.
Figure 3:
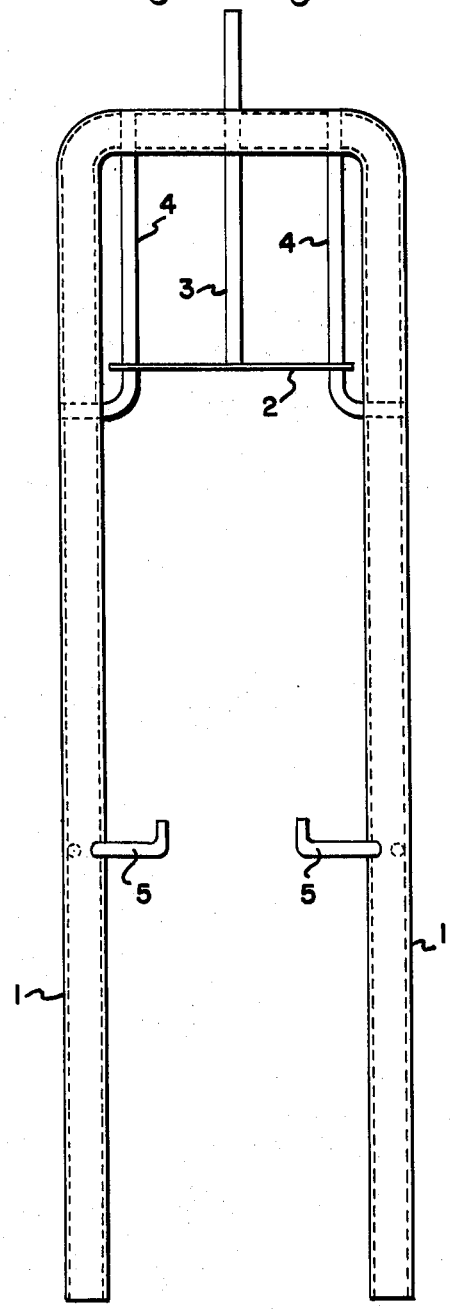
FIG. 3 is a front view.

With reference to the drawing, a U-shaped member is bent from a rod, e.g. hollow 2" aluminum tubing, with the legs of the U being long enough, say 48 to 72 inches, to extend well above the fence. As an example, the legs can be spaced 18" apart center-to-center and can have a length of 63". Alternatively, instead of the U-shaped end, this connecting member can be made of a straight cross member, such as a steel rod or plate, with the vertical legs being rigidly welded or bolted thereto.

A stabilizer plate 2 is slideably affixed to the U-shaped member at the upper portion thereof below the U. As illustrated, two guide rods 4 pass through the ends of the plate and are each affixed to one of the legs at their lower ends and at the upper end are affixed to the cross member of the U. The guide rods permit up and downward motion of plate 2 and present rotation thereof. Plate 2 could be extended such that the legs pass through its ends and eliminating the need for rods 4. However, the projecting ends of plate 2 tend to catch the legs of the user and this is not a preferred construction.

A hand operated rod 3 is affixed to the center portion of the stabilizer plate and slideably passes up through the central portion of the U-shaped member, projecting far enough thereabove to provide a handhold for the user.

The stabilizer plate preferably contains two openings, one generally round and large enough to accommodate the top of most wooden fence posts and the other being smaller and squarer in shape to fit over the end of a conventional metal fence post, as illustrated in FIG. 1.

At least one foot support member 5 is affixed to each leg at a stepping height above the bottom of the leg, i.e. 20 to 30 inches from the bottom, e.g. 24 inches. As illustrated these are metal rods projecting outward from the legs and, it will be noted, turned somewhat inwardly towards the center of the stile which helps distribute the weight placed on the stile by the user in a more balanced manner. More than one foot support or step can be placed on each of the vertical legs as desired.

While not illustrated, the bottom of each leg can have a foot plate at or near the end thereof to distribute the weight of the stile more uniformly over the ground and prevent undue embedding of the legs in soft or wet soil.

Also, the stile can conveniently have a carrying strap attached to one of the legs to permit slinging of the strap over the shoulder and carrying of the stile underneath one's arm.

In service, the user places the stile over a fence at a post in the fence in a generally vertical position and slides plate 2 by means of rod 3 down over the fence post using the appropriate hole in the stabilizer plate 2. Having positioned it, the user puts one foot, say the left foot, on the foot rest nearest him, stands up on that foot rest and swings his right foot over the fence on to the other foot rest followed by placing his weight on his right foot and swinging his left foot over the fence onto the ground on the other side. The user then can pick up the stile and proceed to the next fence crossing.

What is claimed is:

1. A fence stile comprising two spaced-apart generally vertical when-in-use support members adapted to be placed on either side of a fence and having a length sufficient to extend above said fence, a connecting member at the upper portions of said vertical support members and holding said upper portions of said spaced-apart relationship, at least one foot support means on each of said support members a stepping height from the lower ends thereof, and a stabilizer plate generally horizontal in use comprising a plate having an opening adapted to fit over the top of a fence post and slideably attached to said stile between said support members at said upper portions and beneath said connecting member.

2. The stile of claim 1 wherein said stabilizer plate has a vertical rod attached thereto and extending up through said connecting member and adapted to help position said stabilizing plate and to provide a handhold for a user of said stile.

3. The stile of claim 2 wherein said stabilizer plate has two openings therein, one sized to fit a wooden fence post, and the other sized to fit a metal fence post and comprising in addition two guide rods, one each passing through an end of said stabilizer plate and permitting the up-and-down movement of said stabilizer plate between said vertical members and restricting rotation thereof, the lower end of each guide rod being affixed to a vertical member and the upper end to said connecting member.

4. A portable fence stile comprising two spaced-apart generally vertical when-in-use support members adapted to be placed on either side of the fence and having a height sufficient to extend above said fence, a connecting member at the upper portions of said vertical members and rigidly holding said upper portions in said spaced-apart relationship, at least one foot support means on each of said support members a stepping height from the lower end thereof and a stabilizer plate generally horizontal-in-use comprising a plate having an opening adapted to fit over the top of a fence post and slideably attached to said stile between said support members at said upper portions and beneath said connecting member, said stabilizer plate having a vertical rod attached thereto extending up through said connecting member and adapted to help position said stabilizer plate and to provide a handhold for a user of said stile.

5. The stile of claim 4 wherein said stabilizing plate has two openings therein, one sized to fit a wooden fence post and one sized to fit a metal fence post, and comprising in addition two guide rods, one each passing through an end of said stabilizer plate and permitting the up-and-down movement of said stabilizer plate between the vertical members and restricting the rotation thereof, the lower end of each said guide rod being affixed to a vertical member and the upper end to said connecting member.

6. A portable fence stile comprising, in combination:

(a) a U-shaped metal rod of a sufficient strength to support a man and adapted to have the legs thereof placed over a fence in a generally vertical position;

(b) a foot support on each of said legs a stepping distance above the ends of said legs; and (c) a stabilizer plate between said legs at the upper portions thereof slideably connecting therewith and having an opening in said plate adapted to fit over the end of a fence post.

7. The stile of claim 6 wherein said foot supports comprise short rods generally horizontal when in use facing inwardly from the leg to which it is attached and comprising in addition a central vertical rod attached to said stabilizer plate and extending up through the base of said U-shaped metal rod and adapted to help position said stabilizer plate and to provide a handhold for a user of said stile.

8. The stile of claim 7 wherein said stabilizer plate has two holes, one sized to fit a wooden fence post and one sized to fit a metal fence post, and comprising in addition two guide rods, one each passing through an end of said stabilizer plate and permitting the up-and-down movement of said stabilizer plate between said vertical members while restricting the rotary motion thereof, each guide rod being attached at the lower end thereof to one of said legs.

9. The stile of claim 6 wherein said U-shaped rod is a continuous hollow metal tubing of a lightweight metal.

* * * * *